United States Patent [19]

Smith

[11] Patent Number: 4,586,669

[45] Date of Patent: May 6, 1986

[54] METHOD AND APPARATUS OF FORMING CORDS OF HANKING

[75] Inventor: James P. Smith, Cumberland, R.I.

[73] Assignee: H. F. Hanscom, Providence, R.I.

[21] Appl. No.: 775,369

[22] Filed: Sep. 12, 1985

[51] Int. Cl.[4] ..... B65H 54/56; B65H 65/00; B65H 75/28

[52] U.S. Cl. ..... 242/53; 28/291

[58] Field of Search ..... 242/53, 47, 48, 49, 242/50, 1, 127, 7.01, 7.06; 140/92.2, 102; 28/289, 290, 291; 53/116, 118, 119

[56] References Cited

U.S. PATENT DOCUMENTS

| | | | |
|---|---|---|---|
| 2,545,212 | 3/1951 | Ruf | 242/53 |
| 2,559,314 | 7/1951 | Osborne | 242/53 |
| 2,564,803 | 8/1951 | Copp | 242/53 |
| 2,983,984 | 5/1961 | Handzel | 242/53 X |
| 3,375,988 | 4/1968 | Hude et al. | 242/53 X |
| 3,480,219 | 11/1969 | Hanscom | 242/53 |
| 3,480,220 | 11/1969 | Hanscom | 242/53 |
| 3,804,131 | 4/1974 | Holmes et al. | 242/53 X |
| 4,406,109 | 9/1983 | Butler | 242/53 X |

*Primary Examiner*—Stanley N. Gilreath
*Attorney, Agent, or Firm*—Barlow & Barlow, Ltd.

[57] ABSTRACT

A method and apparatus for hanking cords including a pair of jaws for supporting the cord in an elongated position. The jaws being activated to move the cord to a winding turntable that has two upstanding posts. A latching device located at a post of the turntable grips the cord and allows the post to return to its initial position so that the cord may be wound and hanked.

6 Claims, 7 Drawing Figures

METHOD AND APPARATUS OF FORMING CORDS OF HANKING

BACKGROUND OF THE INVENTION

Cord hanking machines are disclosed for example in U.S. Pat. Nos. 3,480,219 and 3,480,220. These patents taken together show apparatus that has a turntable with a pair of upright posts spaced apart thereon, and to wind the cord about the turntable, the operator must manually insert one end of the cord into a clip in the base of the turntable and then actuate the turntable to rotate the same, whereupon the cord is wound about the posts. When the turntable stops after a predetermined number of turns, a gripper arm with fingers on the end thereof moves down and picks up the coil and swings it over into a tying machine where a wire tie is looped around the middle of the coil; the now hanked coil is then ejected into a receptacle. The main difficulty with this type of apparatus is that it is not completely automatic and the speed of operation depends upon the skill of the operator loading the cord. In order to achieve a higher speed of productivity, it would be desirable to have an automatic feeding mechanism to feed the cords to the winding posts. Not only must the cords be fed to the posts, but also they must be held by some form of device which as pointed out above has involved a manual insertion of one end of the cord to the turntable.

SUMMARY OF THE INVENTION

It is the general object of the instant invention to eliminate the manual operation of taking a cord and inserting the same onto a winding turntable so that the same may be wound about the posts that are located thereon. Specifically, the invention provides a fully automatic feeding device for taking a cord and moving one end thereof to a holding position on the turntable from whence it can be wound and then picked up in the apparatus as seen in the above mentioned U.S. Pat. Nos. 3,480,219 and 3,480,220 to be tied into a hanked form.

A method forming cords for hanking in accordance with the principles of this invention includes the steps of supporting a cord in the elongated position, moving the cord to a first work position, as for example at the end of a conveyor belt, and then gripping the cord in gripping jaws where the cord is temporarily gripped. The gripped cord is then moved by the jaws to a second work position adjacent to one of the posts of a winding turntable whereupon the cord is lowered down near the base of the post at which location a clip or latch is located, the clip securing the cord on the winding turntable, the jaws then releasing the cord and moving out of the way so that the cord may be wound about the winding posts.

An apparatus for delivering cords to the winding turntable in accordance with the principles of this invention includes at least means for moving a cord to a first position to permit jaws to grip the cord. The jaws are then moved over to the winding post and then lowered engaging a latch located adjacent to the base of the posts resulting in resiliently securing the cord held by the jaw. Means then move the jaws out of position and back to original datum and the turntable containing the posts may then be rotated so that the cord is wound about the posts.

DETAILED DESCRIPTION OF THE PREFERRED EMBODIMENT

The apparatus which embodies the principles of this invention includes means such as conveyers generally designated 10,10*a*, a cord justifier generally designated 12, cord clamping jaws generally designated 14, 14*a* and a rotating turntable generally designated 16 for winding the cord about a pair of upstanding posts.

Figure 2:
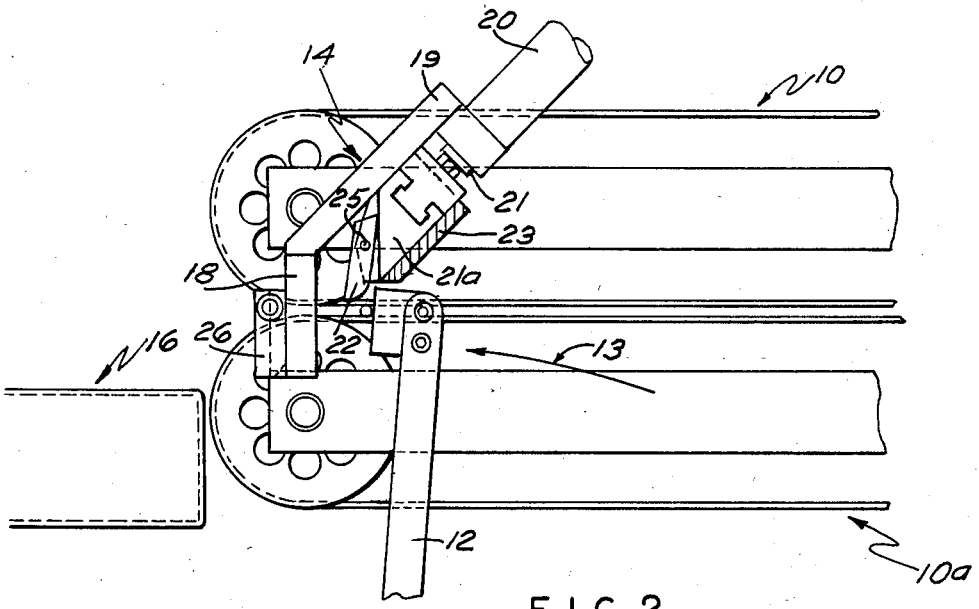
FIGS. 2–7 are a sequence of views showing the steps in gripping and delivering the cord to a latching station where the cord is latched against a post of the turntable.
Figure 1:
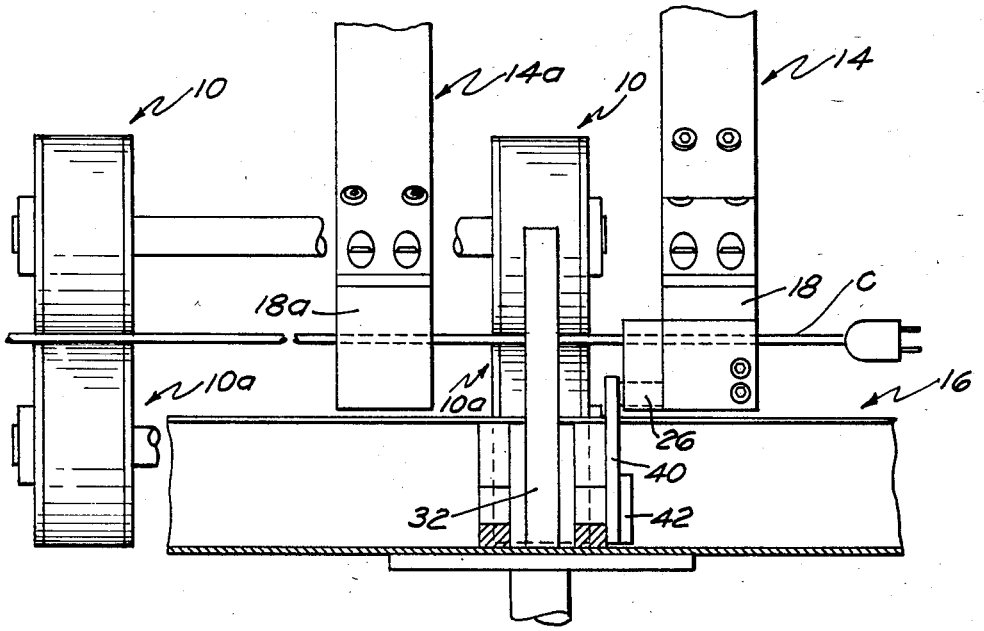
FIG. 1 is a elevational view illustrating by way of example conveyers that may be used to deliver the cord to the jaws that grip the cord and move the cord to a latching position at the post of the turntable.
Figure 3:
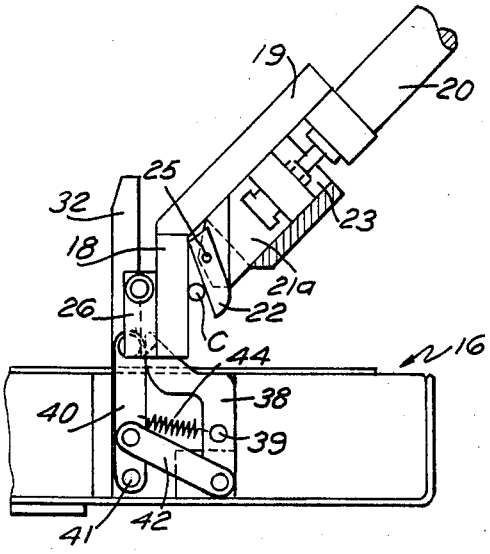
Figure 4:
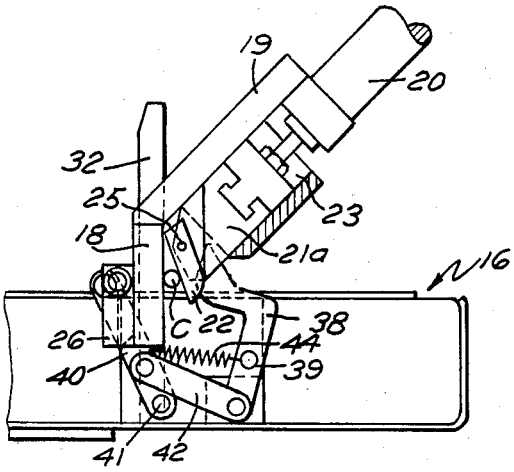
Figure 5:
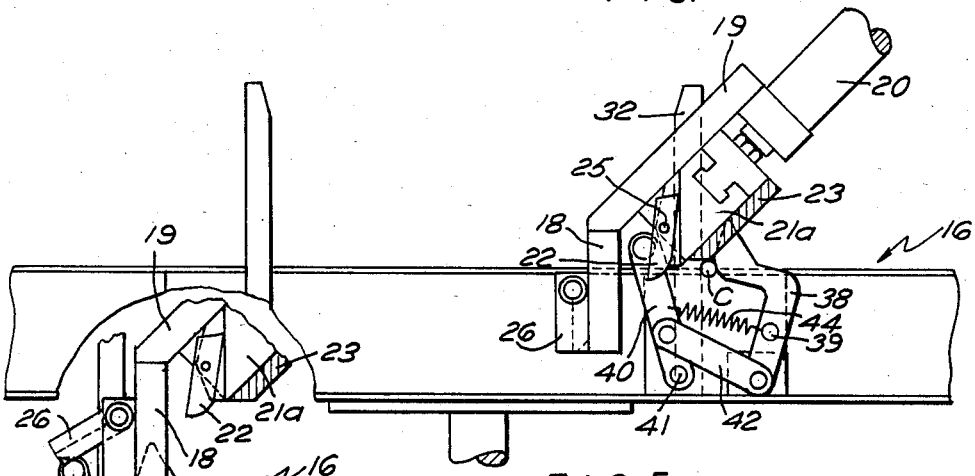
Figure 6:
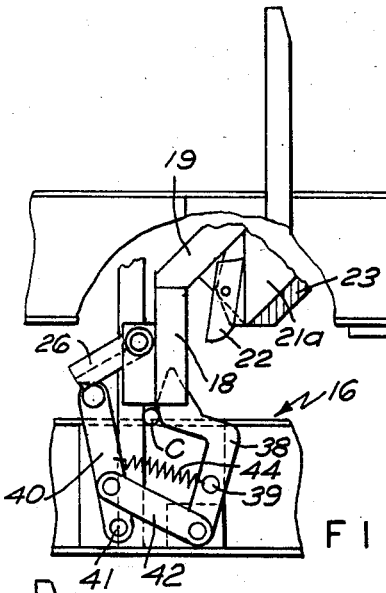
Figure 7:
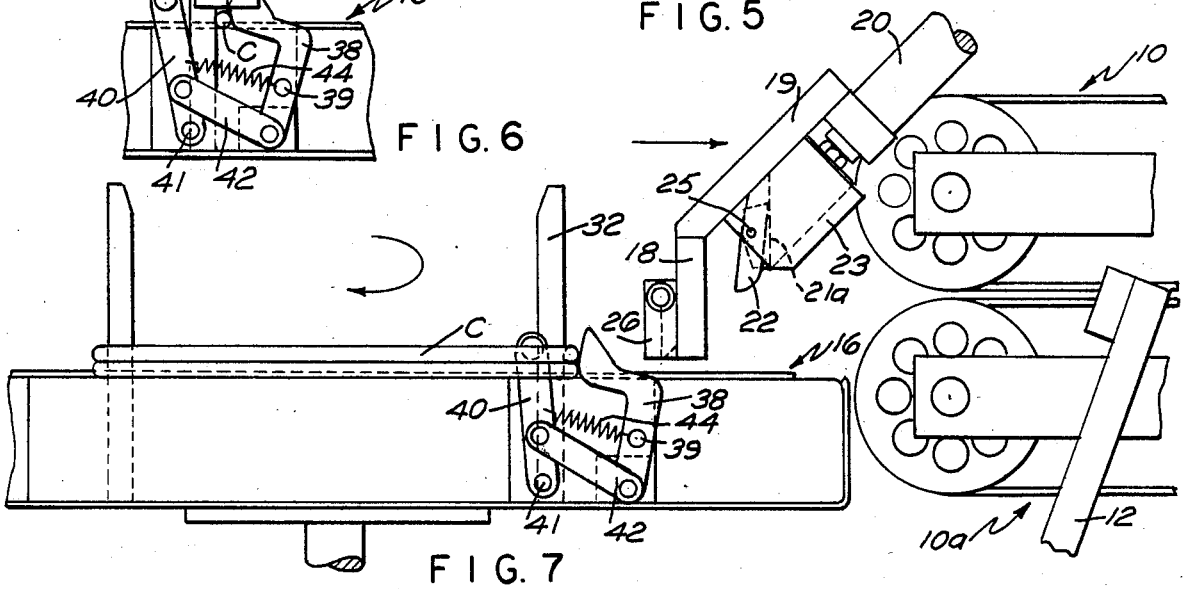

The overall apparatus that carries out the principles of the method of this invention are shown in the sequence of views identified as FIGS. 2–7. Referring first to FIG. 2, the cord C is moved in a handling system such as conveyers 10 and 10*a* to the position shown in FIG. 2. The jaws 14 and 14A are moved into the position seen in FIGS. 1 and 2 and a cord justifier 12 moves in the direction of the arrow 13 behind the cord C and then positions the cord up against the jaw plate 18 to justify the cord position. Clamping means shown in the form of a piston 20 actuate a pivoted clamping finger 22 and grip the cord as seen in FIG. 3 and then the jaw assembly moves to the left as seen in the drawing to a winding post 32 of the turntable 16. As the jaws continue to advance to the left as seen in the drawing and downwardly, a toggle dog 40 is engaged by flipper 26 that opens the clip arm 38 as seen in FIG. 4. Continued downward movement of the jaws, disengages the toggle dog 40 and allows the clip arm 38 to engage the cord, as seen in FIG. 5. The jaws now move upwardly and rearwardly to their initial position, and as they do, a one way flipper 26 rides over the roller of the dog 40 as seen in FIG. 6. When the jaws clear the winding fingers, as seen in FIG. 7, the turntable drum begins to rotate to wind the cord about the winding posts and the jaws continue to return to their initial position as seen in FIG. 2. The coiling operation will be discontinued after a predetermined number of turns and will return to datum position with the posts in line with the jaws as seen in FIG. 1, at which point in time the coiled material may be picked up and suitably tied into hanked form at another work station.

The jaws 14 and 14*a* are identical in construction and as briefly alluded to above, each consists of a pneumatic cylinder 20 that has a piston rod 21 extending therefrom to which is attached a pusher block 21*a* that is captured in a slide guide 23. Extending forwardly from the piston 20 and secured thereto is a plate 19 to which a downwardly depending jaw plate 18 and 18*a* is affixed. A spring loaded clamping finger 22 in the form of a plate is pivoted as at 25 and as seen in the drawing is engageable by the block 21*a*. On the forward side of the jaw 18 to one side thereof as seen in FIG. 1, is a flipper 26 in the form of a L shaped plate.

Referring now to FIGS. 3–7, the latching device for the cord at the posts consists of a clip arm 38 pivoted as at 39. The arm 38 is operated by a dog 40 pivoted as at 41 that is connected to the clamping arm via a toggle 42. A tension spring 44 connected to the dog 41 and to a fixed point near pivot point 39, will maintain the latch in normal closed position by action through toggle 42. As can be seen by the sequential drawings, the action is relatively simple in that moving the arm 40 to the left opens the jaw 38 and release of pressure thereon will return the jaw to a position where the same can releasably clip the cord against the winding post 32.

I claim:

1. A method of forming cords for hanking on a rotatable turntable having upstanding posts which includes the steps of supporting a cord in elongated position;

gripping the cord at spaced locations near one end thereof;

moving the gripped cord to a work position;

securing the cord near the end thereof to one of the posts on a winding turntable and releasing the gripped cord and winding the cord about winding posts.

2. A method as in claim 1 including moving the cord beyond the winding post to ensure engagement therewith.

3. In a cord hanking machine means for moving a cord to a first work position;

a pair of spaced cord gripper jaws;

first means gripping the cord in the jaws;

a winding turntable having two upstanding posts;

second means moving the jaws to a post of the turntable;

a latching device located at a post of the turntable;

means associated with the movement of said jaws engaging the latching device to open and close the latching device and grip the cord;

said means returning the jaws to their initial position; and means rotating the turntable to wind the cord about the posts.

4. The cord hanking machine as in claim 3 including a justifier arm insuring that the cord is placed in a position to be gripped by the jaws.

5. The cord hanking machine as in claim 3 wherein the latching device is a spring loaded pivoted arm operated by a dog and toggle.

6. The cord hanking machine as in claim 5 wherein the means engaging the latching device is a one-way flipper pivoted to one of the jaws.

* * * * *